US012624605B2

(12) United States Patent
Fuglestad

(10) Patent No.: US 12,624,605 B2
(45) Date of Patent: May 12, 2026

(54) WELL TOOL WITH AN ANGLE ORIENTING FEATURE

(71) Applicant: WELL CONVEYOR AS, Bryne (NO)

(72) Inventor: Kenneth Fuglestad, Bryne (NO)

(73) Assignee: WELL CONVEYOR AS, Bryne (NO)

( * ) Notice: Subject to any disclaimer, the term of this patent is extended or adjusted under 35 U.S.C. 154(b) by 0 days.

(21) Appl. No.: 18/691,791

(22) PCT Filed: Sep. 13, 2022

(86) PCT No.: PCT/NO2022/050209
§ 371 (c)(1),
(2) Date: Mar. 13, 2024

(87) PCT Pub. No.: WO2023/043316
PCT Pub. Date: Mar. 23, 2023

(65) Prior Publication Data

US 2024/0344413 A1 Oct. 17, 2024

(30) Foreign Application Priority Data

Sep. 15, 2021 (NO) ..... 20211108

(51) Int. Cl.
*E21B 23/00* (2006.01)
*E21B 17/10* (2006.01)
*E21B 23/14* (2006.01)

(52) U.S. Cl.
CPC ..... *E21B 23/001* (2020.05); *E21B 17/1057* (2013.01); *E21B 23/14* (2013.01)

(58) Field of Classification Search
CPC .... E21B 23/001; E21B 17/1057; E21B 23/14; E21B 23/00
See application file for complete search history.

(56) References Cited

U.S. PATENT DOCUMENTS 4,415,030 A * 11/1983 Walkow ..... E21B 17/1057 166/241.5
5,040,619 A 8/1991 Jordan et al.
(Continued)

FOREIGN PATENT DOCUMENTS

| | | | |
|---|---|---|---|
| NO | 20140083 | A1 | 7/2015 |
| WO | 2015112022 | A1 | 7/2015 |
| WO | 2023043316 | A1 | 3/2023 |

OTHER PUBLICATIONS

International Search Report dated Nov. 30, 2022 concerning International Application No. PCT/NO2022050209, 3 pp.

*Primary Examiner* — Brad Harcourt

(57) ABSTRACT

The present invention relates to a well tool 1 adapted to be centralized in a well. The well tool includes an angle orienting feature, for orienting the well tool 1, 50 around a longitudinal axis of the well tool. The well tool includes at least three wheels 3, 53 each adapted to define a wheel contact point. Each wheel extends from a longitudinal well tool body 6, 56 and is adapted to contact a well inner wall. The well tool 1 includes a swivel 28 adapted to allow the well tool to be attached to a longitudinal element 29 and to allow the longitudinal element 29 to rotate in relation to the well tool. The angle orienting feature is adapted to orient the at least three wheels 3, 53 extending from the well tool body 6, 56 away from a lower portion of the well inner wall 44 when the well is inclined or horizontal.

9 Claims, 4 Drawing Sheets

(56) References Cited

U.S. PATENT DOCUMENTS

| | | | | |
|---|---|---|---|---|
| 8,770,303 | B2 * | 7/2014 | Aguirre | E21B 17/1078 166/381 |
| 10,774,604 | B2 | 9/2020 | Fuglestad | |
| 10,954,726 | B2 * | 3/2021 | Hradecky | E21B 17/1057 |
| 2006/0278405 | A1 | 12/2006 | Turley et al. | |
| 2012/0145380 | A1 | 6/2012 | Draper et al. | |
| 2013/0068479 | A1 | 3/2013 | Aldossary et al. | |
| 2013/0299188 | A1 * | 11/2013 | Ahmed | E21B 23/14 166/117.6 |
| 2014/0238659 | A1 * | 8/2014 | Wheater | E21B 17/1078 166/85.5 |
| 2018/0135359 | A1 | 5/2018 | Hradecky et al. | |
| 2018/0187504 | A1 | 7/2018 | Boge | |
| 2020/0256145 | A1 * | 8/2020 | Bonavides | E21B 4/18 |
| 2021/0002967 | A1 | 1/2021 | Vasireddy et al. | |
| 2021/0277725 | A1 | 9/2021 | Martin et al. | |

* cited by examiner

WELL TOOL WITH AN ANGLE ORIENTING FEATURE

The present invention relates to a centralized well- or pipe tool with a centralization and orientation feature to centralize and orient the tool and other equipment in curved and horizontal wells and pipes in such a manner that wheels of the well- or pipe tool stays away from any sand/dirt or debris at the bottom of the horizontal or inclined pipe or well.

Sand, dirt or debris are often located at a bottom of the pipe profile in and pipes that are curved or horizontal. There is often a need to make interventions by inserting equipment into pipes with elements such as: coiled tubing, rod or pulling tools and cables. There is a great risk that the equipment gets stuck in sand and/or debris inside the pipe, thus preventing progress. Pipes typically include long stretches in a horizontal direction. Several sections of sand and/or debris may therefore be have to be negotiated, giving increased resistance between the pipe and the equipment.

There is a need for a centralization and orientation method allowing the centralizing tool and other equipment to passes over sand and/or debris lying at the bottom of the pipe profile.

In some situations, it is required to run well interventions through pipe restrictions. Smaller pipes in an upper vertical part of a well pipe may have to be passed before going into a larger pipe in a horizontal part of the pipe. It may therefore be necessary to utilize a centralization method/equipment allowing centralization in varying sized pipes. In addition, the centralization should preferably be carried out while avoiding sand and/or debris lying at the bottom of the pipe profile. Tools may have a small inner diameter and nipple profiles all the way down to 43 mm.

There are several variants of centralization tools for boreholes and pipes on the market. A known solution includes arc springs that are biased towards the pipe wall and centralize a string in the pipe. Other methods include using flexible arms with rolling wheels biased against the pipe wall, centralizing the string in the pipe.

The arms or arc springs are typically in contact with the pipe wall at three locations or more around a longitudinal axis of the tool. With four flexible arms will these typically be oriented 90 degrees in relation to each other about the longitudinal axis. With three flexible arms will these typically be oriented 120 degrees in relation to each other about the longitudinal axis. If one of these methods are used in a horizontal drilling pipe with sand on the bottom of the pipe profile, will most likely one of the arms or arched springs be located in a portion of the pipe with sand or debris. The centralization tool then works against its purpose, which in most cases is to reduce the resistance of the string/tool in the pipe. Instead of reducing the friction in the string, the resistance is increased considerably as the tool/string is guided through sand and/or debris.

There are several variants of traction tools or well tractors on the market. One known solution includes an electric motor driving a hydraulic pump which in turn drives a hydraulic motor in a drive wheel. Such a system is technically complex and has a low efficiency. Other variants utilize an electric motor that transmits the rotation directly via an angular gear and on to the wheel either via chain/belt drive or a straight gear.

The present invention provides a centralization and orientation tool and method, allowing centralization to be achieved without any parts of the tool/string having to pass through sand or debris lying on the bottom of the pipe profile.

With the tool of the present invention, it is possible to centralize a string efficiently and easily and at the same time orient the string so that the string stays clear of sand and/or debris lying at the bottom of the pipe profile.

The tool of invention comprises two or more rocker arms which are oriented 180 degrees relative to each other in relation to a longitudinal axis of the string, one or more swivels and an orienting feature. The rocker arms may include either freely rolling wheels or driven wheels.

The orienting feature ensures that the arms are oriented substantially horizontally allowing the arms to extend out to each side of the longitudinal axis of the string.

Pipe, pipeline, bore, well, wellbore, tubing, tubing string, casing, casing string, drill pipe, etc. are expressing locations where the present invention may be used. In this disclosure is pipe and well used for simplicity for all these types of applications. The term "Well tool" is intended to cover any tool suitable for use in any well, pipeline, etc. as mentioned above and is not restricted to use in connection with wells, but may also be used in any sort of pipelines typically used to convey oil, gas or water.

The present invention concerns a well tool adapted to be centralized in a well. The well tool comprises an angle orienting feature for orienting the well tool around a longitudinal axis of the well tool. The well tool includes at least three wheels each adapted to define a wheel contact point and wherein each wheel extends from a longitudinal well tool body and is adapted to contact a well inner wall. The well tool includes a swivel adapted allow the well tool to be attached to a longitudinal element (such as coiled tubing or some kind of line) and to allow the longitudinal element to rotate in relation to the well tool. The angle orienting feature is adapted to orient the at least three wheels extending from the well tool body away from a lower portion of the well inner wall.

The angle orienting feature may be provided by a centre of gravity of a wheeled portion of the well tool offset from and below a center of the well tool when the well tool is in a horizontal or close to horizontal operating position.

The at least three wheels may be located in a wheeled portion of the well tool and the well tool may further include a second portion adapted to be attached to the wheeled portion and the swivel. The offset center of gravity of the well tool may then be provided by an orienting element between the wheeled portion and the second portion, and may include two pivoting single axis joints joining two connection elements allowed to pivot around an axis of rotation in relation to an interconnection piece between the two connection elements, whereby the wheeled portion, the interconnection piece and the second portion are adapted to form a ramp step shaped well tool.

The well tool may further include at least one high density weight to provide the centre of gravity of the wheeled portion of the well tool offset from and below a center of the well tool when the well tool is in a horizontal or close to a horizontal operating position.

The at least one high density weight may be integrated in the well tool to provide the offset centre of gravity.

The at least one weight in the longitudinal well tool may be located in a separate detachable portion of the well tool to provide a removable angle orienting feature.

The well tool may be attached to a coiled tubing, and the angle orienting feature may include a gravity sensor and an actuator adapted to rotate the well tool in relation to the coiled tubing and wherein the gravity sensor is adapted to control the actuator.

The angle orienting feature may include a gravity sensor and an actuator adapted to turn and steer at least one the at least three wheels to steer and rotate the well tool in relation to the well inner wall.

The at least three wheels may be located in one wheel-plane, and the angle orienting feature may be adapted to keep the wheel-plane horizontal.

The well tool may be acting as a freely rolling centralizer or may take the role as a well tractor with propulsion on one or several wheels. A part of the well tool may include a battery, and the well tool may be battery driven.

Furthermore, the invention concerns a well tool as described above in an inclined or horizontal well with a well inner wall and at least one of sand and debris resting against a bottom portion of the well inner wall, wherein the at least three wheels extending from the longitudinal well tool body contacts the well inner wall at the wheel contact points at locations away from the bottom portion of the well inner wall.

Figure 1:
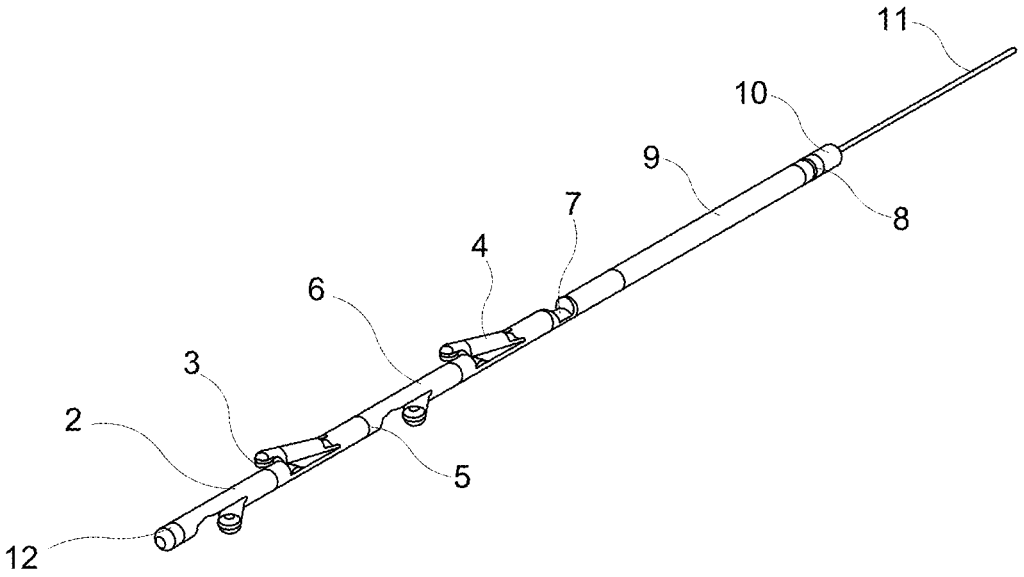
FIG. 1 is a perspective view of a well tool of the invention with an angle orienting feature in a first embodiment.

Detailed description of embodiments of the invention with reference to the figures: FIG. 1 shows an embodiment of a well tool 1 adapted to be centralized in a well in the form of a propulsion tool 1 with an angle orienting feature of the invention. The propulsion tool 1 includes four propulsion modules 2, each with a driven wheel 3 on a pivoted arm 4 pivotally supported in a propulsion module body 6. The four propulsion modules 2 are joined in module joints 5. The propulsion modules 2 include a biasing mechanism pressing the pivoted arm 4 out from the propulsion module body 6 to provide traction for the driven wheel 3 against a pipe wall. The biasing mechanism may just include elastic elements or may include actuators allowing controlled extension and retraction of the driven wheel. An orienting element 7 includes an offset CG (center of gravity) portion with a centre of gravity at a distance from a central, longitudinal axis. A swivel 8 allows the propulsion tool 1 to revolve freely in relation to a cable head 10 with a longitudinal element such as cable 11 around the central, longitudinal axis. A battery module 9 is located between the orienting element 7 and the swivel 8. The orienting element 7 is located between the battery module 9 and a propulsion module. The each of the driven wheels 3 includes an axis of rotation and the axis of rotation of the four driven wheels 3 are parallel. The four driven wheels 3 are also substantially in the same plane forming a wheel plane. The orienting element 7 is designed to locate this wheel plane with a horizontal component across a transversal cross-section of a pipe. This wheel plane will thus be horizontal when a pipe with the propulsion tool 1 is horizontal. An end element 12 reinforces an end of the propulsion tool 1.

The orienting element 7 is provided as at least one of the propulsion modules 2 and the downhole tool includes a C of G offset from the longitudinal central axis of the centralizing tool in a position that will locate the freely rotating wheels 3 in a plane with a horizontal component in a transversal direction of a pipe. (The plane of the wheels is perpendicular to an axis of rotation of the wheels).

Figure 2:
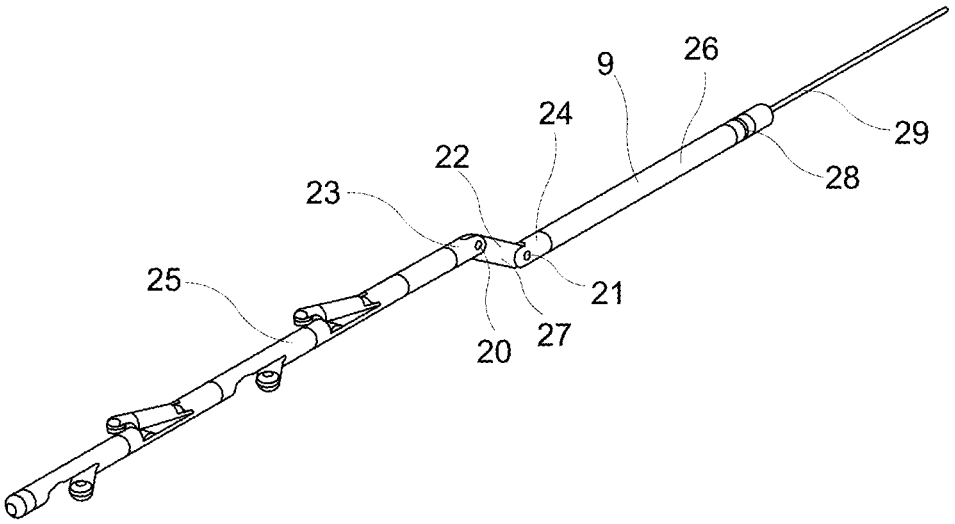
FIG. 2 is a perspective view of a well tool of the invention with an angle orienting feature in a second embodiment.

FIG. 2 shows an embodiment of a propulsion tool 1 with an angle orienting feature of the invention substantially as above, but where the orienting element 27 includes two knuckle joints 20,21 joining two connection elements 23, 24 and an interconnection piece 22. Each of the joints 20, 21 allows the connection elements 23, 24 to pivot around an axis of rotation in relation to the interconnection piece 22. The axes of rotation of the two joints 20, 21 are parallel, whereby the two connection elements 23, 24 and the interconnection piece 22 can form a ramp step, allowing the weight of the battery portion 9 to orient the propulsion wheels as explained above with a horizontal component in relation to the cross-section of the pipe. The well tool is divided into a wheeled portion 25, a second portion 26 and the orienting element 27 is located between the wheeled portion 25 and the second portion 26. The second portion 26 typically includes a battery or electronic circuits, sensors, and various other instruments. The weight of the second portion is thus used to provide the well tool with a "low" centre of gravity to provide the horizontal position of the wheels away from debris, sand and dirt. The horizontal component of the wheel plane allows the wheels of the propulsion tool to stay clear of any sand or debris at the bottom of the pipe, thus reducing the resistance for the propulsion tool in the pipe.

Figure 3:
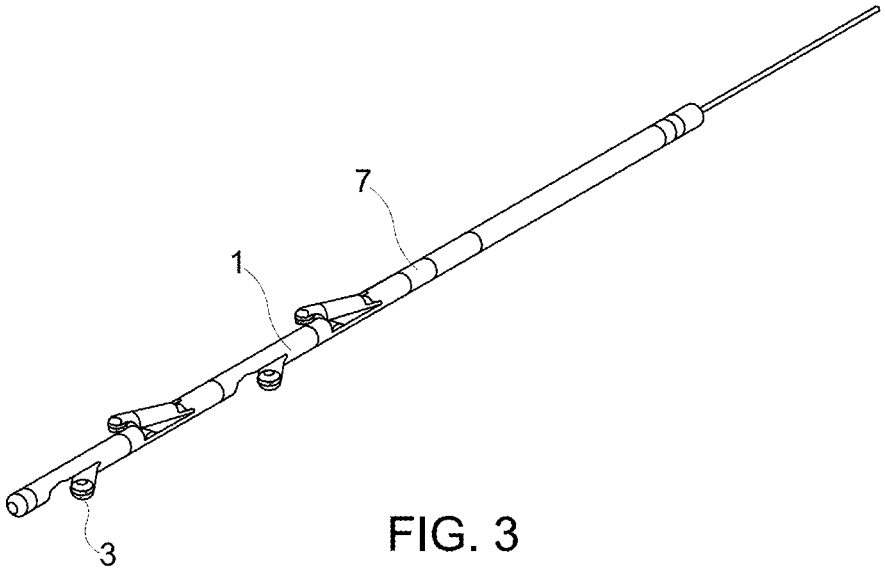
FIG. 3 is a perspective view of a well tool of the invention with an angle orienting feature in a third embodiment.

FIG. 3 shows an embodiment of a propulsion tool 1 with an angle orienting feature of the invention substantially as above, but where the orienting element 7 includes a gravity sensor actively orienting the propulsion modules 2 into a position where the driving wheels 3 stays away from any debris or sand in the pipe. The orienting element 7 may include an actuator controlled by the gravity sensor to rotate at least the propulsion modules around their longitudinal axis to clear the debris. In some situation the debris may be located to one side and not completely at the bottom of the pipe and in this situation may the wheel plane not necessarily be completely horizontal or include a horizontal component as explained above.

Figure 4:
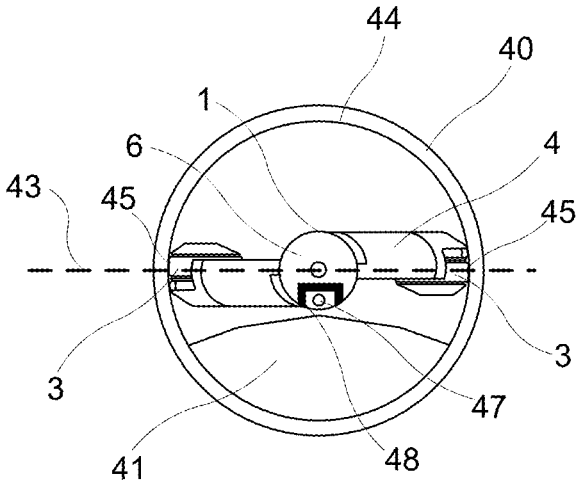
FIG. 4 is a front view of the first embodiment of the well tool of the invention.

FIG. 4 is a cross section of a pipe 40 with a propulsion tool 1 with an angle orienting feature of the invention including the propulsion wheels 3 and the pivoted arms 4, pivotally supported in the propulsion module body 6. A longitudinal axis 42 (FIG. 7) of the pipe 40 is indicated as a dot at the center of the pipe 40. A horizontal component 43 of a plane through the pipe 40 extends through the longitudinal axis 42. Debris 41 is located at the bottom of the pipe 40. The propulsion tool 1 is free to move above the debris 41. The angle orienting feature is provided by a centre of gravity 47 in a transversal direction of the well tool below the wheel contact points 45. FIG. 4 is also representative for the other embodiments, apart from the high-density weight 48 to offset the centre of gravity that may be omitted in some embodiments.

Figure 5:
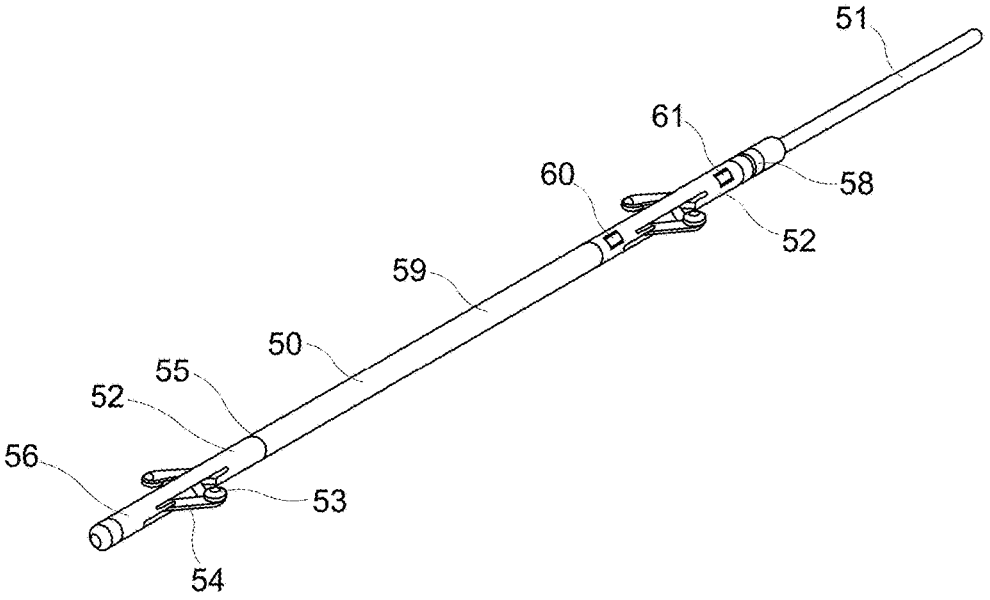
FIG. 5 is a perspective view of a well tool of the invention with an angle orienting feature in a fourth embodiment.

FIG. 5 shows an embodiment of a centralizing tool 50 of an embodiment of the invention. The centralizing tool 50 includes four freely rotating wheels 53 on four pivoting arms 54 in two centralizing modules 52. Each of the two centralizing modules 52 is joined with a downhole tool 59 such as a logging tool in a centralizing module joint 55.

The two centralizing modules 52 include a biasing mechanism pressing the pivoted arms 54 out from the centralizing module body 56 to provide contact between the freely rotating wheels 53 and the pipe wall. Each of the two centralizing modules 52 includes two freely rotating wheels 53 on two pivoting arms 54 in two centralizing modules 52. A swivel 58 is located between a coiled tubing 51 and the centralizing tool 50. The coiled tubing 51 can push or pull the downhole tool 50 in or out of the pipe.

The orienting element 7 is integrated in any of the components and include a mechanism with a gravity sensor mechanism 60 controlling an actuator 61 to rotate the tool in the longitudinal direction to ensure that the wheels 53 stays away from any debris at the bottom of a pipe/well.

Figure 6:
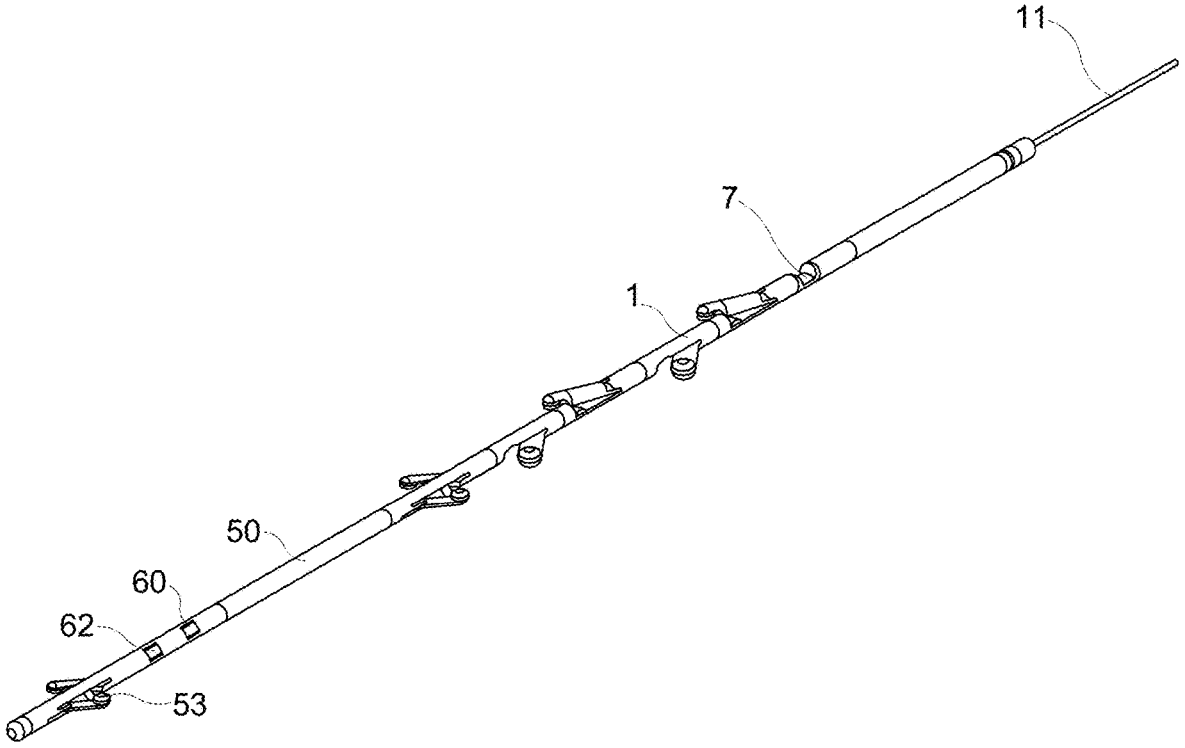
FIG. 6 is a perspective view of a well tool of the invention with an angle orienting feature in a fifth embodiment.

FIG. 6 shows an embodiment of a centralizing tool 50 as shown in FIG. 5 in combination with a propulsion tool 1 as show in in any of the FIGS. 1-4. The orienting element 7 is located between the combination of the tools and the cable 11. All the wheels are located in one wheel plane. In FIG. 6, the orienting feature is constituted by a gravity sensor 60 controlling at least one actuator turning/pivoting at least one wheel to control and "steer" and rotate the tool in relation to its longitudinal axis to ensure that the wheels 53 stay away from any debris at the bottom of a pipe/well.

Figure 7:
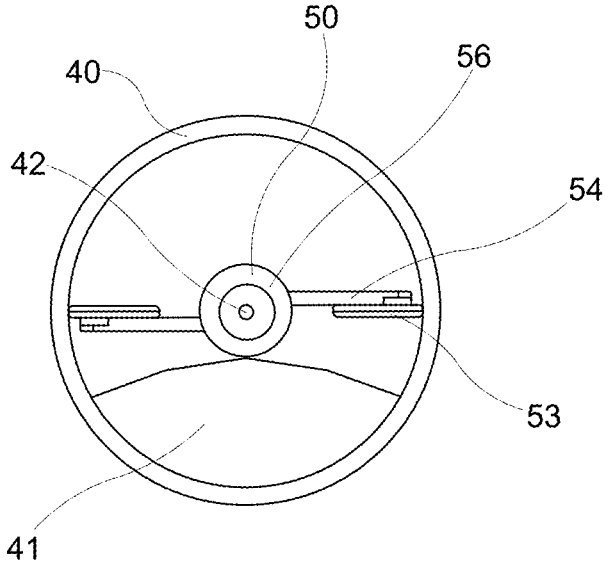
FIG. 7 is a front view of the invention in common for all the embodiments.

FIG. 7 substantially corresponds to FIG. 4 and shows an embodiment of a centralizing tool 50 of the invention substantially as above, in a cross section of a pipe 40 with the centralizing wheels 53 and the pivoted arms 54, pivotally supported in the centralizing module body 56. A longitudinal axis 42 of the pipe 40 is indicated as a dot at the center of the pipe 40. In FIG. 4, the longitudinal axis 42 of the pipe 40 coincides with the central, longitudinal axis of the tool 50.

A horizontal component 43 (FIG. 4) of a plane through the pipe 40 extends through the central longitudinal axis 42. Debris 41 is located at the bottom of the pipe 40. The centralizing tool 50 is free to move above the debris 41 as the wheels roll along the well inner wall.

It should be noted that the features of the different embodiments can be combined and that for instance the embodiment with offset centre of gravity can be combined with embodiment with the actuator to save power while the position is ensured.

It is also noted that the term "well" is intended to cover both lined wells, open wells and pipes. It should also be mentioned the term "bottom portion of the well" and "bottom portion of the pipe" is in relation to an inclined or horizontal pipe and is related to the lower part of the pipe or bore cross-section as shown in FIG. 7.

The invention claimed is:

1. A well tool (1) adapted to be centralized in a well, the well tool comprising an angle orienting feature, for orienting the well tool (1, 50) around a longitudinal axis of the well tool, the well tool including at least three wheels (3, 53) each adapted to define a wheel contact point and wherein each wheel extends from a longitudinal well tool body (6, 56) configured to be centralized in the well, and wherein each wheel is adapted to contact a well inner wall (44), wherein the well tool (1) includes a swivel (28) adapted to allow the well tool to be attached to a longitudinal element (29) and to allow the longitudinal element (29) to rotate in relation to the well tool (1), whereby the angle orienting feature is configured to orient the at least three wheels (3, 53) extending from the well tool body (6, 56) away from a lower portion of the well inner wall (44) when the tool is deployed in an inclined or horizontal well, wherein the angle orienting feature is provided by a centre of gravity (47) of a wheeled portion of the well tool (1, 50) offset from, and below a center of the well tool (1) when the well tool (1, 50) is in a horizontal or close to horizontal operating position, and wherein the at least three wheels (3, 53) are located in the wheeled portion (25) of the well tool (1), the well tool (1) further including a second portion (26) adapted to be attached to the wheeled portion (25) and the swivel (28), and wherein the offset center of gravity (47) of the well tool (1, 50) is provided by an orienting element (27) between the wheeled portion and the second portion (26), whereby the wheeled portion (25), the interconnection piece (22) and the second portion (26) are adapted to form a ramp step shaped well tool.

2. The well tool (1) of claim 1, further including at least one weight (48) to provide the centre of gravity (47) of the wheeled portion of the well tool (1, 50) offset from and below a center of the well tool (1) when the well tool (1, 50) is in a horizontal or close to horizontal operating position to provide the angle orienting feature.

3. The well tool (1) of claim 2, wherein the at least one weight (48) is integrated in the well tool (1) to provide the offset centre of gravity (47) and to provide the angle orienting feature.

4. The well tool (1) of claim 2, wherein the at least one weight (48) in the longitudinal well tool body (6, 56) is located in a separate detachable portion of the well tool providing a removable angle orienting element (7) and to provide the angle orienting feature.

5. The well tool (1) of claim 1, wherein the well tool is attached to a coiled tubing (51), and wherein the angle orienting feature includes a gravity sensor (60) and an actuator (61) adapted to rotate the well tool (1) in relation to the coiled tubing (51), and wherein the gravity sensor is adapted to control the actuator (61).

6. The well tool (1) of claim 1, wherein the angle orienting feature includes a gravity sensor (60) and an actuator (62) adapted to turn and steer at least one the at least three wheels (3, 53) to steer and rotate the well tool in relation to the well inner wall (44).

7. The well tool (1) of claim 1, wherein the at least three wheels (3) are located in one wheel-plane, and wherein the angle orienting feature is adapted to keep the wheel-plane horizontal.

8. The well tool (1) of claim 1 in an inclined or horizontal well with the well inner wall (44) and at least one of sand and debris resting against a bottom portion of the well inner wall, wherein the at least three wheels (3, 53) extending from the longitudinal well tool body (6, 56) contacts the well inner wall (44) at the wheel contact points at locations away from the bottom portion of the well inner wall (44).

9. The well tool (1) of claim 1 wherein each of the at least three wheels (3, 53) is adapted to simultaneously contact the well inner wall (44).

* * * * *